United States Patent [19]

Bolliand et al.

[11] 4,050,982

[45] Sept. 27, 1977

[54] PROCESS AND APPARATUS FOR CONTINUOUSLY SHRINKING A NON-WOVEN SHEET

[75] Inventors: Robert Bolliand, Lyon; Claude Saligny, Ecully, both of France

[73] Assignee: Rhone-Poulenc-Textile, France

[21] Appl. No.: 461,341

[22] Filed: Apr. 16, 1974

[30] Foreign Application Priority Data

May 18, 1973 France ..... 73.18439

[51] Int. Cl.[2] ..... D21D 3/00

[52] U.S. Cl. ..... 162/100; 26/18.5; 68/175; 68/202; 162/157 R; 162/202; 162/207; 162/289

[58] Field of Search ..... 162/100, 202, 207, 280, 162/289, 290, 157 R, 197; 26/18.5, 18.6; 134/122, 64; 68/175, 202; 162/197; 28/76 R, 76 T

[56] References Cited

U.S. PATENT DOCUMENTS

| | | | |
|---|---|---|---|
| 1,686,388 | 10/1928 | Lorenz | 162/280 |
| 2,128,516 | 8/1938 | Graham | 68/202 |
| 2,866,254 | 12/1958 | Ball | 68/202 |
| 3,032,465 | 5/1962 | Selke et al. | 162/207 |
| 3,086,275 | 4/1963 | Pritchard | 28/76 R |
| 3,253,317 | 5/1966 | Such | 28/76 R |
| 3,826,178 | 7/1974 | Taylow | 162/197 |

FOREIGN PATENT DOCUMENTS

| | | |
|---|---|---|
| 1,168,076 | 12/1958 | France |

*Primary Examiner*—S. Leon Bashore
*Assistant Examiner*—Peter Chin
*Attorney, Agent, or Firm*—Stevens, Davis, Miller & Mosher

[57] ABSTRACT

The invention relates to a process and an apparatus for continuously shrinking a fibrous sheet containing heat-shrinkable fibers by means of a hot liquid, wherein a sheet is driven by a continuous, stable film formed on the emerged surface of a series of aligned cylinders with parallel axes rotated in the direction of the advance of the sheet and partially immersed in a hot liquid without the sheet being in contact with the cylinders. The invention makes it possible to shrink uniformly and at a high speed heat-shrinkable fibers obtained from an aqueous dispersion thereof by a paper-making method.

5 Claims, 1 Drawing Figure

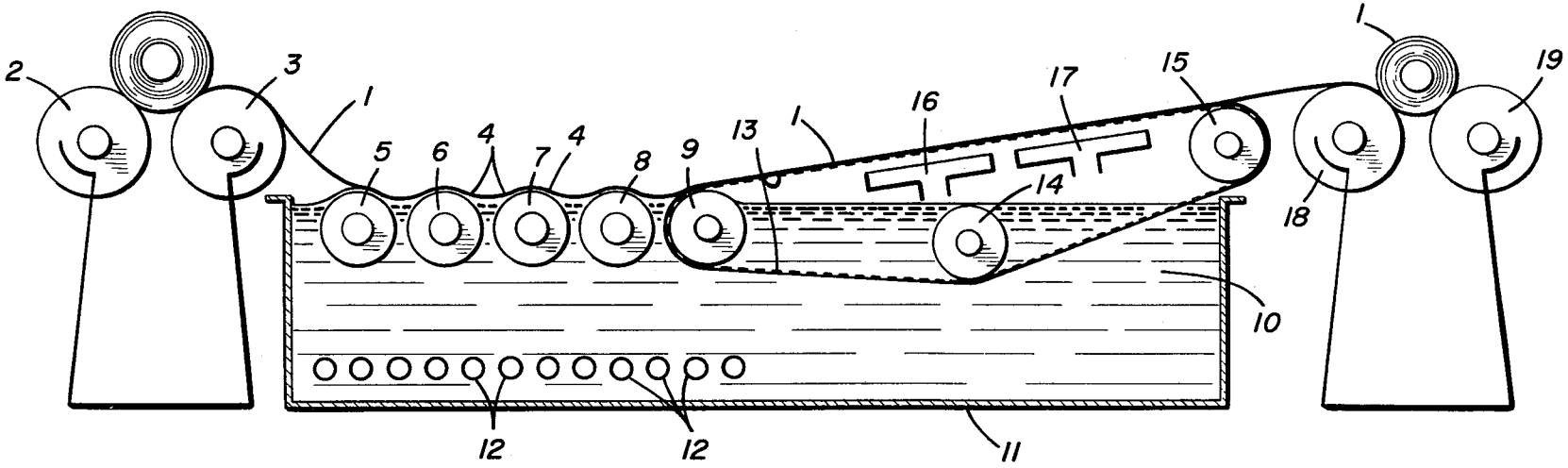
19
1
18
15
17
16
1
13
9
8
4
7
4
6
5
1
3
2
10
14
11
12
12

PROCESS AND APPARATUS FOR CONTINUOUSLY SHRINKING A NON-WOVEN SHEET

The present invention relates to a process for continuously shrinking a nonwoven fibrous sheet containing heat-shrinkable fibers with a hot liquid. It also concerns the apparatus for the carrying out of the process.

During the manufacture of nonwoven sheets, there are frequently introduced into these sheets fibers which have a latent potential to shrink under heat and to then cause the shrinkage of the fibers by heat treatment. Various types of shrinkable fibers can be used — some decrease in length and increase in volume, which makes it possible to impart bulk to the sheet, while others retain the same length but are crimped which gives them a shorter appearance; they impart better coherence to the sheet since they intermesh during the shrinkage. One can also use composite fibers side by side whose components have different heat-shrinkage properties and which shrink unevenly to assume a helicoidal crimp. Such fibers are of particular interest since they make it possible to obtain deformable sheets having a marked textile appearance and feel.

Up to now various methods of shrinking fibrous sheets with heat have been used including either dry treatments or wet treatments.

The dry treatments are carried out generally in the following manner: the sheet is subjected to a stream of hot air, for instance in an apparatus such as described in French Pat. No. 1,336,249, to infrared radiation or else the sheet is passed over a heating plate.

These treatments do not give good results since in each of them the sheet is arranged on a support which brakes and interferes with the shrinkage mechanism; furthermore, it has been found that it is more difficult to shrink dry fibers than wet fibers so it is preferred to effect shrinkage of wet fibers.

The sheet can be immersed in a bath of hot water, as described, for instance, in French Pat. No. 1,427,148, but this method also has a drawback — the sheet obtained lacks coherence since the fibers have a tendency to disperse in the bath.

The sheet can also be subjected to the action of a stream of hot water flowing over an inclined support, but this process is uneconomical since it requires a large amount of hot water.

It is therefore an object of this invention to provide a process for shrinking sheet material containing shrinkable fibers which is devoid of the foregoing disadvantages. Another object of the invention is to provide an improved wet process for shrinking sheet material containing heat-shrinkable fibers and an apparatus for use in practicing the process.

Other objects will become apparent from the following description with reference to the accompanying drawing wherein one embodiment of the apparatus provided by the invention is illustrated diagrammatically.

The foregoing objects and others are accomplished in accordance with this invention by providing a process wherein a fibrous sheet which contains fibers which are heat-shrinkable is continuously drawn loosely over a series of cylinders partially immersed in a hot liquid and having a coating of the hot liquid on the exposed surfaces thereof which is sufficiently thick, firm or stable to prevent the sheet from contacting the surfaces of the cylinders as it passes thereover. The cylinders or cylindrical drums are aligned with parallel axes and are rotated in the direction the sheet is travelling. It has been found that the process makes it possible to shrink uniformly a nonwoven fiber sheet moving at a high rate of speed with a heated liquid.

The invention also provides an apparatus for carrying out the process, which is characterized by the fact that it comprises a series of aligned cylinders with parallel axes, a receptacle containing a hot liquid in which the cylinders are only partially immersed, means for driving the cylinders in rotation in the same direction as the sheet is travelling, at a speed which brings about the formation on the exposed surfaces of the cylinders of a continuous, stable liquid film capable of supporting the sheet without it touching the surfaces of the cylinders, means for bringing the sheet without tension into contact with the said film, and finally means for removing the liquid and drying the sheet after treatment.

The fibrous sheets suitable for carrying out the invention can be made by any of the techniques used for disposing or arranging fibers in the form of a sheet or web. These techniques include those which are carried out in the dry, such as simple carding, Garnett-type carding, and depositing by air, and those which are carried out by a wet method from an aqueous dispersion of fibers and which are the customary papermaking techniques. It is obvious that any sheet containing shrinkable fibers can be shrunk in accordance with the present invention regardless of how it was formed. Such shrinkable sheets include nonwoven sheets formed of continuous filaments, fabrics, paper and the like. The fibers or filaments which enter into the composition of these sheets may have a base of a natural polymer (wool) or any synthetic polymer such as polyamides, polyesters, polyacrylonitrile, polyolefins, polyvinyl chloride, mixtures thereof, copolymers or the like, provided that at least a part of the fibers are heat-shrinkable.

In accordance with the invention, the thermal treatment is effected by any suitable hot liquid but water is preferred. The sheet to be shrunk is driven along by the stable, continuous liquid film which is formed on the exposed surface of the cylinders when these cylinders are partially immersed in the liquid, and are driven in rotation. The film must be of sufficient thickness to cause the sheet to advance without rubbing taking place between the sheet and the surface of the cylinders, which rubbing could interfere with the shrinkage mechanism. This thickness is a function of the weight of the sheet, and it is obvious that it will be greater the greater the weight of the sheet. In general it has been found that good results are obtained if, in the case of light sheets, that is to say, sheets weighting between 10 and 150 g/m2, the film formed on cylinders of about 110 mm in diameter has a thickness of between 0.2 and 1 mm and if, in the case of heavier sheets, that is to say, weighing between 150 and 300 g/m2, this thickness is between 1 and 3 mm. The thickness of the film can be easily regulated by controlling the speed of the cylinders and the level of the liquid in the tank. In order to fall under the conditions determined above, it is preferred to rotate the cylinders at a speed between 1 and 200 meters/minute and to maintain a liquid level located between 10 and 20 mm below the top of the cylinders in the case of light sheets and between 2 and 10 mm in the case of heavier sheets.

For carrying out the process of the invention the sheet is brought without tension by any means, generally by two feed cylinders, into contact with the liquid film which causes it to advance while the fibers shrink freely. It is necessary to provide a sufficient number of cylinders and to select a suitable diameter for them such that the shrinkage is complete at the end of the passage, that the liquid films retain a constant temperature, and that the path of the sheet be substantially flat in order to avoid its deformation. Four to ten cylinders are preferably employed.

In accordance with the invention, the cylinders which are aligned and have their axes parallel are spaced a distance apart which is relatively small as compared with their diameter, generally 1 to 5 mm in the case of cylinders of a diameter of 110 mm, if one desires a good driving of the sheet and to avoid the creation of turbulence, as well as splashing of liquid out of the bath. The supply of hot liquid in the tank can be effected in any manner. For instance, a tank provided with an overflow which makes it possible to maintain the level of water constant and with cylinders which are only partially immersed may be filled with cold water. Coils containing super heated steam may be located in the lower portion of the tank to heat the water. After the sheet has passed over the liquid film, water absorbed by the sheet is permitted to drip therefrom and the sheet is then dried continuously in a conventional manner, such as, for instance by means of a pair of squeezing rollers, and a heated oven. In accordance with a preferred embodiment of the invention, the last cylinder is associated with a slightly inclined conveyor belt which travels above the tank and is provided on its lower face with suction boxes which return liquid removed from the sheet to the tank.

The shrinkage process of the invention has the following advantages: the sheet borne by the liquid film retains its coherence since the fibers do not have the possibility of dispersing themselves in the bath. Because the fibers are not in contact with a rigid support, they shrink freely, and are under good conditions and the flow of liquid maintains the temperature constant during the shrinkage, which assures good uniformity of the shrink sheet. Finally, the process is economical since it can be carried out at high speeds (greater than 50 meters/minute) as compared with those used up to the present time with the conventional methods.

It may be pointed out that the invention is of particular interest in the case of sheets obtained by the wet method from an aqueous dispersion of fibers, since the device can be integrated between the paper machine and the liquid-removal device.

The accompanying drawing shows how the invention can be carried out, without, however, limiting it.

In this FIGURE, a sheet 1 containing heat-shrinkable fibers is brought without tension by means of two feed rollers 2 and 3 into contact with a continuous, stable liquid film 4 formed on the exposed surface of the cylinders 5 to 9 which are rotated in the direction of the advance of the sheet 1 by a motor (not shown in the FIGURE). The cylinders 5 to 9 are immersed only partially in a liquid 10 contained in a tank 11 and heated by means of tubes 12 containing superheated steam, which are located in the lower portion of the tank 11. The cylinder 9 drives a perforated endless conveyor belt 13 which is slightly inclined above the tank, travelling around cylinders 9, 14 and 15. Liquid is removed from sheet 1 by means of two suction boxes 16 and 17 located below the upper portion of the conveyor belt 13. The sheet 1 is then wound up by means of the winding cylinders 18 and 19.

The following example serves to illustrate the invention, without limiting it.

EXAMPLE

At the outlet of a paper machine, a sheet of a width of 150 cm, weighting 80 g/m2, formed of 70% paper staple fibers of 10 mm in length and a size of 3.3 dtex (3 den.) and 30% heat-shrinkable composite fibers composed of 50% ethylene glycol polyterephthalate of a melting point of between 200° and 203° C and 50% of a copolyester of 95% ethylene glycol polyterephthalate and 5% dimethyl propanediol polyterephthalate of a melting point of 228° C, of a length of 10 mm, a size of 1.7 dtex (1.5 den.), is shrunk continuously after water has been removed in the press section down to 30% dryness, by bringing it into contact with the stable, continuous water film formed on the device shown in FIG. 1. The feed cylinders bring the sheet at a speed of 20 meters/minute into contact with the water film formed on the top of seven stainless steel cylinders of a diameter of 110 mm, spaced 5 mm apart, rotating in the direction of the advance of the sheet at 20 meters/minute. The cylinders are immersed in the tank up to a height of 95 mm; the thickness of the water film on the cylinders is 0.8 mm and the temperature of the water is 95° C. The water is removed from the sheet on the conveyor belt 13 by means of the suction boxes 16 and 17 down to 30% dryness. After final drying by passage over heating rollers of 140° C for one minute, it is found that the resulting sheet weighs 125 g/m2, has shrunk 20% in both dimensions, that it has a uniform pebbly appearance and a pleasing touch, and therefore that the shrinkage has taken place under good conditions.

Although the invention has been described in detail for the purpose of illustration, it is to be understood that such detail is solely for that purpose and that variations can be made therein by those skilled in the art without departing from the spirit and scope of the invention except as it may be limited by the claims.

What we claim is:

1. A process for the continuous shrinking of a sheet of fibers containing heat-shrinkable fibers by means of a hot liquid, which comprises passing the sheet loosely over at least one cylinder partially immersed in a liquid maintained at a temperature which will cause shrinkage of the shrinkable fibers, said cylinder having a surface exposed above the liquid which is coated with a stable liquid film which prevents the sheet from touching the surface of the cylinder, said cylinder being rotated in the direction the sheet travels, and removing absorbed liquid from the sheet.

2. An apparatus for shrinking a sheet which contains heat-shrinkable fibers which comprises a tank containing a liquid heated at a temperature which will cause shrinkage of the shrinkable fibers at a constant level, at least one cylinder rotatably disposed in the tank with a surface exposed above the level of the liquid, means for rotating the cylinder at a speed whereby a continuous, stable liquid film is carried on the exposed surface thereof, said film covering the sheet without it touching the surface of the cylinder, means for putting the sheet loosely into contact with the film carried by the cylinder in the same direction as the cylinder is rotated, and means for removing liquid from the sheet.

3. A method for shrinking a fibrous sheet which contains heat-shrinkable fibers which comprises rotating at least one cylinder in a liquid maintained at a temperature which will cause shrinkage of the shrinkable fibers in the sheet while maintaining a level of liquid below the top surface of the cylinder at a speed whereby a film of liquid is carried by the cylinder on its exposed surface which supports the sheet against contact with the surface of the cylinder, passing the said sheet loosely without restraint over the cylinder and in contact with the said film and thereafter removing liquid absorbed by the sheet therefrom.

4. An apparatus for shrinking a sheet containing heat-shrinkable fibers comprising a container containing a liquid, means for heating liquid in the container to a temperature where the fiber will shrink, a series of rotatable cylinders supported in the container at a position where each cylinder is only partially submerged in said liquid, and has an exposed surface carrying a film of said liquid thereon, said film conveying the sheet without it touching the surface of the cylinders, means for unwinding a roll of sheet material, pass it loosely over the cylinders without restraint in contact with the said film whereby said web is supported against contact with said cylinders, and rewind it, and means for removing said liquid from the sheet prior to rewinding.

5. The apparatus of claim 4 wherein said means for removing said liquid comprises a perforated endless belt associated with vacuum means for removing water from the sheet.

* * * * *